US005685036A

United States Patent [19]

Kopfstein et al.

[11] Patent Number: 5,685,036

[45] Date of Patent: Nov. 11, 1997

[54] ALTERNATING PRESSURE MATTRESS SYSTEM AND METHOD

[75] Inventors: Allen Kopfstein, Foxboro, Mass.; Norman Dieter, Pleasantville; Jack Wilkerson, Pleasant Valley, both of N.Y.

[73] Assignee: Geomarine Systems, Inc., Carmel, N.Y.

[21] Appl. No.: 602,097

[22] Filed: Feb. 15, 1996

[51] Int. Cl.[6] ..... A61G 7/04

[52] U.S. Cl. ..... 5/713; 5/710

[58] Field of Search ..... 5/710, 711, 713, 5/715

[56] References Cited

U.S. PATENT DOCUMENTS

| | | | |
|---|---|---|---|
| 4,825,486 | 5/1989 | Kimura et al. | 5/713 |
| 4,993,920 | 2/1991 | Harkerload et al. | 5/713 X |
| 5,035,016 | 7/1991 | Mori et al. | 5/713 |
| 5,117,518 | 6/1992 | Schild | 5/713 |
| 5,243,721 | 9/1993 | Teasdale | 5/713 X |
| 5,267,364 | 12/1993 | Volk | 5/713 |

*Primary Examiner*—Michael F. Trettel
*Attorney, Agent, or Firm*—John H. Crozier

[57] ABSTRACT

In one preferred embodiment, an alternating pressure mattress system, including: a mattress including a plurality of narrow, parallel, closely-spaced, horizontally adjacent air sacks, every other one of the air sacks forming a first group of air sacks being commonly connected for the introduction thereinto of pressurized air and the others of the air sacks forming a second group of air sacks and being commonly connected for the introduction thereinto of pressurized air; apparatus to supply the pressurized air to the first and second groups of air sacks; control apparatus to alternatingly inflate and deflate the first and second groups of air sacks for selected periods of time; and the control apparatus providing for intervals of time at inflation/deflation transitions during which periods of time the pressurized air is being furnished to both the first and second groups of air sacks.

2 Claims, 5 Drawing Sheets

ALTERNATING PRESSURE MATTRESS SYSTEM AND METHOD

BACKGROUND OF THE INVENTION

1. Field of the Invention

The present invention relates to alternating pressure mattress systems generally and, more particularly, but not by way of limitation, to novel alternating pressure mattress and method that provide for stabilizing patient level on the mattress.

2. Background Art

A major problem in health care facilities is with bed-bound patients who cannot turn, roll over, or otherwise change position. Failure of a patient to change position relatively frequently causes restriction of blood flow in the area of bony protruberances on a patient's body which, in turn, causes ulcerated bed, or pressure, sores. Such sores are extremely long-healing and, with a chronically or terminally ill patient, frequently occur. According to hospital industry sources several years ago, it was estimated that to cure a single bed sore cost society an average of $40,000 and many patients die from bed sores.

In order to alleviate the foregoing problem, there has been developed the alternating pressure mattress which consists of a plurality of narrow, parallel, closely-spaced, horizontally adjacent air sacks arranged so that their major axes are disposed laterally underneath a patient's body. A supply air circuit is arranged so that the sacks share a common air supply, with sets of "odd" and "even" sacks being alternately inflated and deflated. Thus, the support surfaces under all areas of the patient's body are periodically deflated to minimize or prevent the formation of pressure sores.

The control system of a conventional alternating pressure mattress system directs pressurized air alternately to one or the other of the sets of odd and even air sacks. During the time the sets of sacks undergo inflation/deflation transitions, the patient experiences disturbing vertical motion of about one to two inches. This is a consequence of the fact that the deflation process proceeds faster than the inflation process. The deflation rate is rapid since the patient's body is pressing on the sacks, helping force the air out, whereas the inflation rate is slow, due to the limited capacity of the small air pump that is typically supplied with these systems and due to the weight of the patient's body.

Accordingly, it is a principal object of the present invention to provide improved alternating pressure mattress and method that provide for stabilizing patient level during inflation/deflation transitions.

It is a further object of the invention to provide such mattress and method that are economical and easily controlled.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing in one preferred embodiment, an alternating pressure mattress system, comprising: a mattress comprising a plurality of narrow, parallel, closely-spaced, horizontally adjacent air sacks, every other one of said air sacks comprising a first group of air sacks being commonly connected for the introduction thereinto of pressurized air and the others of said air sacks comprising a second group of air sacks and being commonly connected for the introduction thereinto of pressurized air; means to supply said pressurized air to said first and second group of air sacks; control means to alternatingly inflate and deflate said first and second groups of air sacks for selected periods of time; and said control means providing for intervals of time at inflation/deflation transitions during which periods of time said pressurized air is being furnished to both said first and second groups of air sacks.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
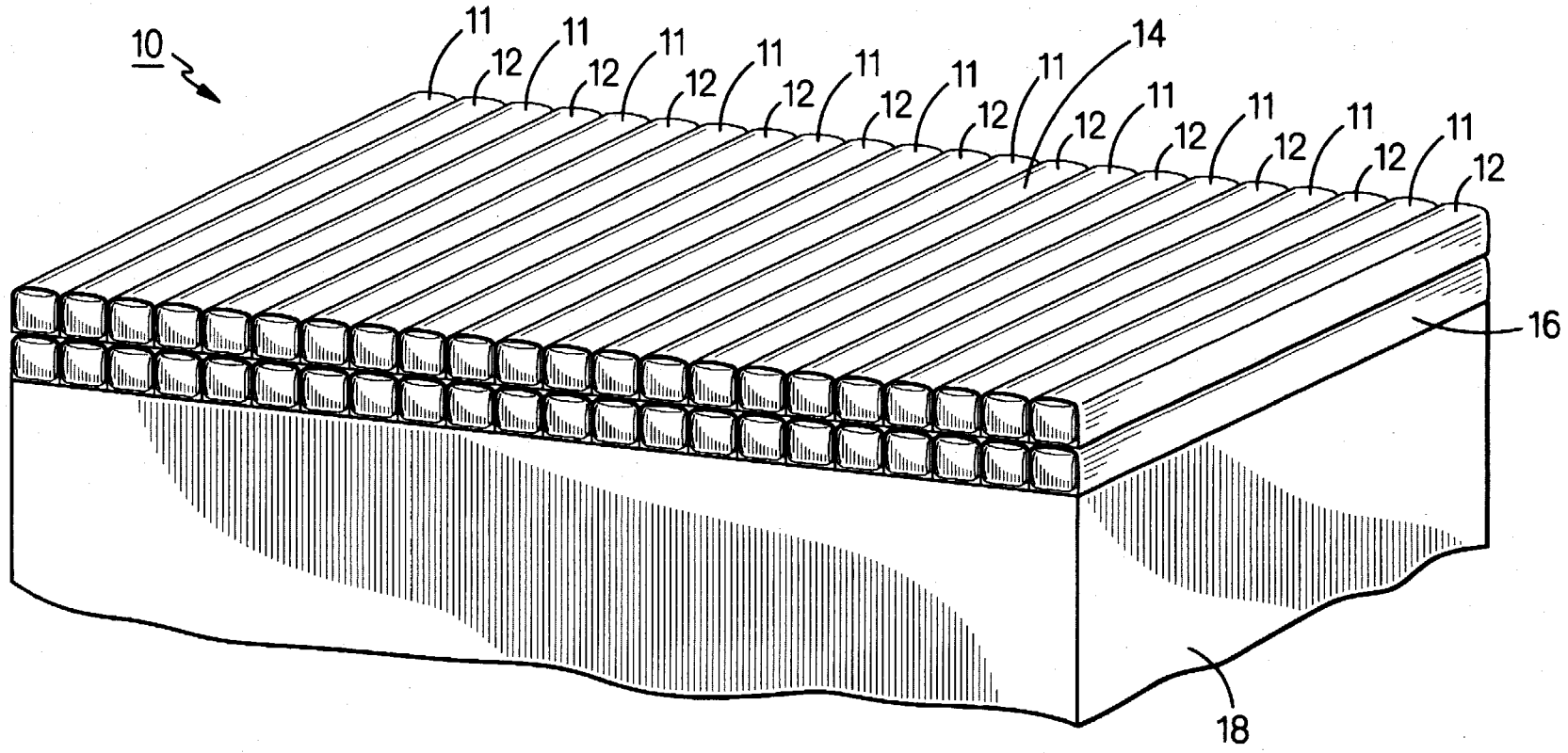
FIG. 1 is an isometric view of an alternating pressure mattress.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a conventional alternating pressure mattress, generally indicated by the reference numeral 10, shown without the means for inflation or deflation. Mattress 10 includes a plurality of of narrow, parallel, closely-spaced, horizontally adjacent, flexible, "odd" air sacks 11 and "even" air sacks 12, arranged so that the major axes of the odd and even air sacks are disposed laterally underneath the body of a patient (not shown), and forming an upper mattress structure 14. Odd and even air sacks 11 and 12 total twenty-two in number and are about four inches wide to form a mattress eighty-eight inches long. A lower mattress structure 16, substantially identical to upper mattress structure 14, underlies the upper mattress structure. Mattress 10 is shown disposed on a frame or other supporting member 18. As is noted above, the air supply to mattress 10 is arranged to that, alternatingly, air sacks 11 and 12 are inflated and deflated to relieve pressure on a patient's body (not shown). All the air sacks of lower mattress structure 16 are evenly inflated at the same pressure to provide overall support for the patient's body; however, as also noted above, during inflation/deflation transitions, the patient experiences disturbing vertical motion. Lower mattress 16 remains inflated at all times to provide some continuing support for the patient and to isolate the patient from support 18.

Figure 2:
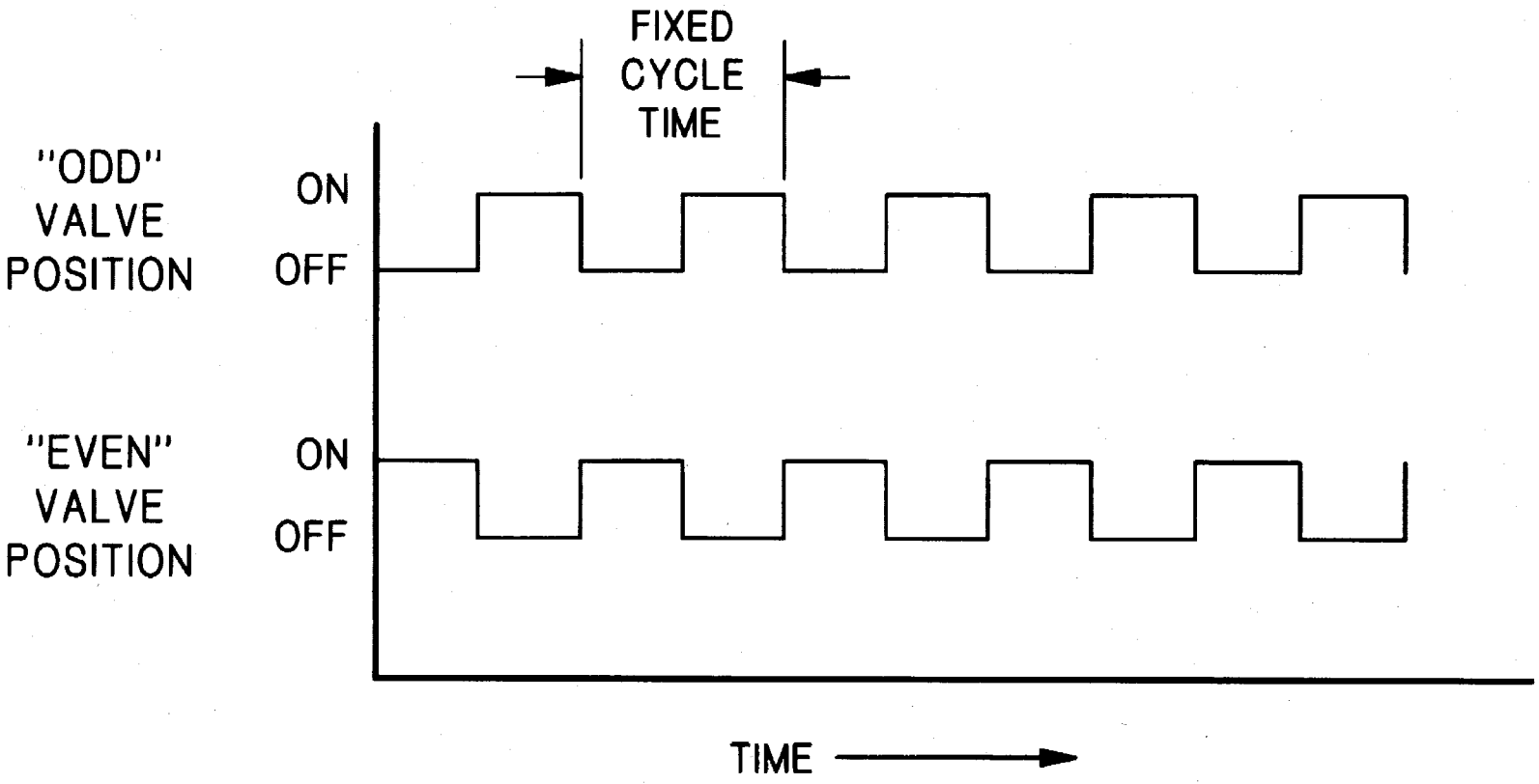
FIG. 2 (PRIOR ART)
FIG. 2 shows inflation/deflation waveforms according to the conventional method of inflating/deflating an alternating pressure mattress.

FIG. 2 illustrates the conventional method of controlling inflation/deflation of air sacks 11 and 12, in which valving (not shown) directing inflation air to one set of sacks 11 or 12 ("odd" or "even") is placed in an "open" condition at the same time that valving (not shown) permitting deflation of the other set of sacks 11 or 12 is placed in an "off" condition. Due to the fact that deflation takes place more rapidly than inflation because of the weight of the body of the patient, the resulting discontinuity in patient support occurs with the concomitant disturbing vertical motion.

Figure 3:
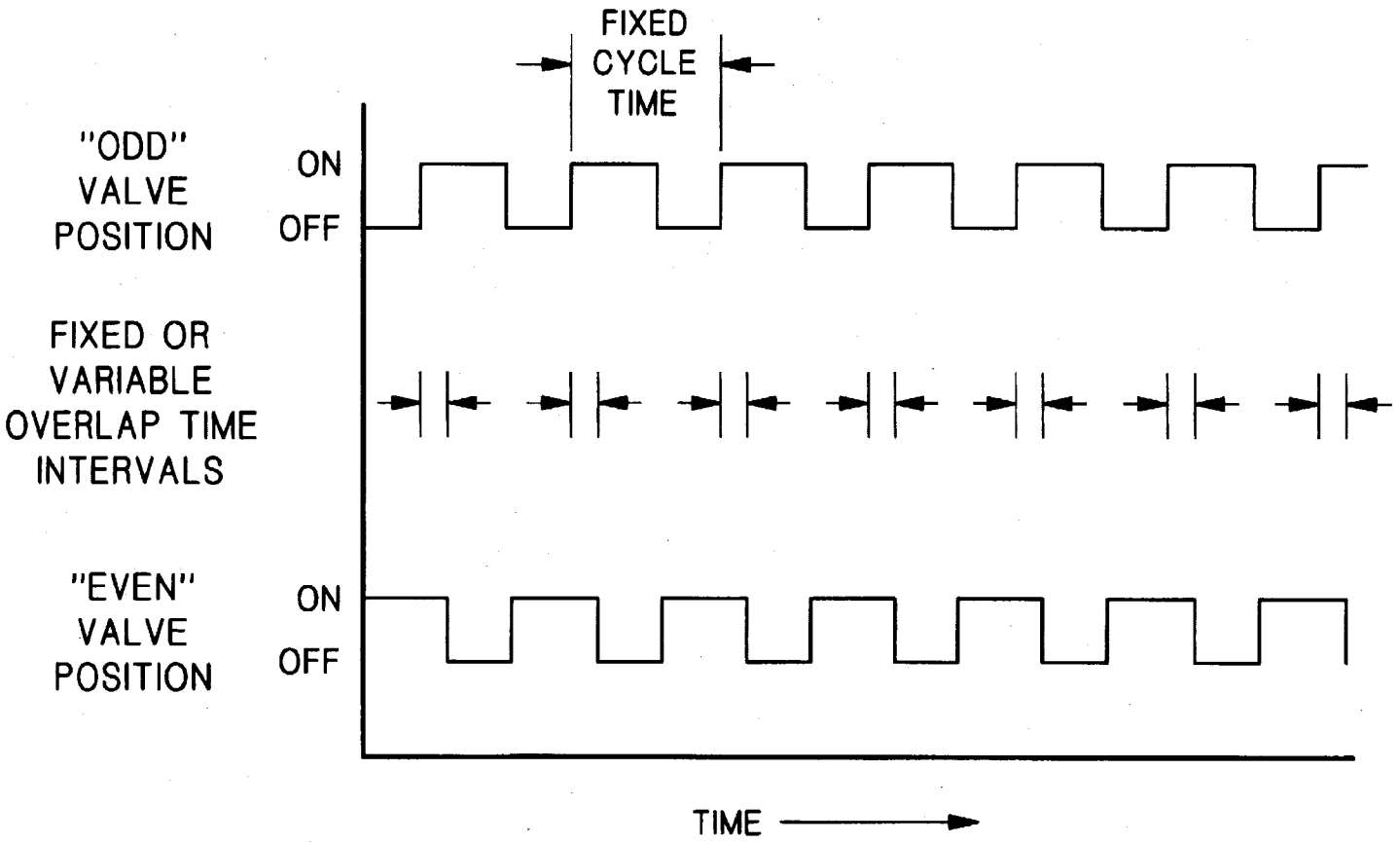
FIG. 3 shows inflation/deflation waveforms for an alternating pressure mattress, according to one embodiment of the present invention.

FIG. 3 illustrates an improvement over the conventional system of alternating pressure mattress control, according to one embodiment of the present invention. Here, control of the valving is arranged such that, with reference, for example, to the first transition, when the even air sacks are approaching the time for deflation, the odd air sacks are inflated for a fixed or variable overlap time during which pressurized air is supplied to both even and odd air sacks. Here, for a nominal 5-minute-on-five-minute-off cycle, there is provided a one-minute overlap, for example, such that the odd and even sacks are in an inflation mode for 6 minutes and in a deflation mode for 4 minutes. This overlap tends to assure that the odd air sacks are inflated before deflation of the even air sacks and results in the reduction of patient lowering during on/off transitions, but does not entirely eliminate it, since some pressure reduction occurs in the inflated air sacks as the deflated air sacks are inflated from the common air supply.

Figure 4:
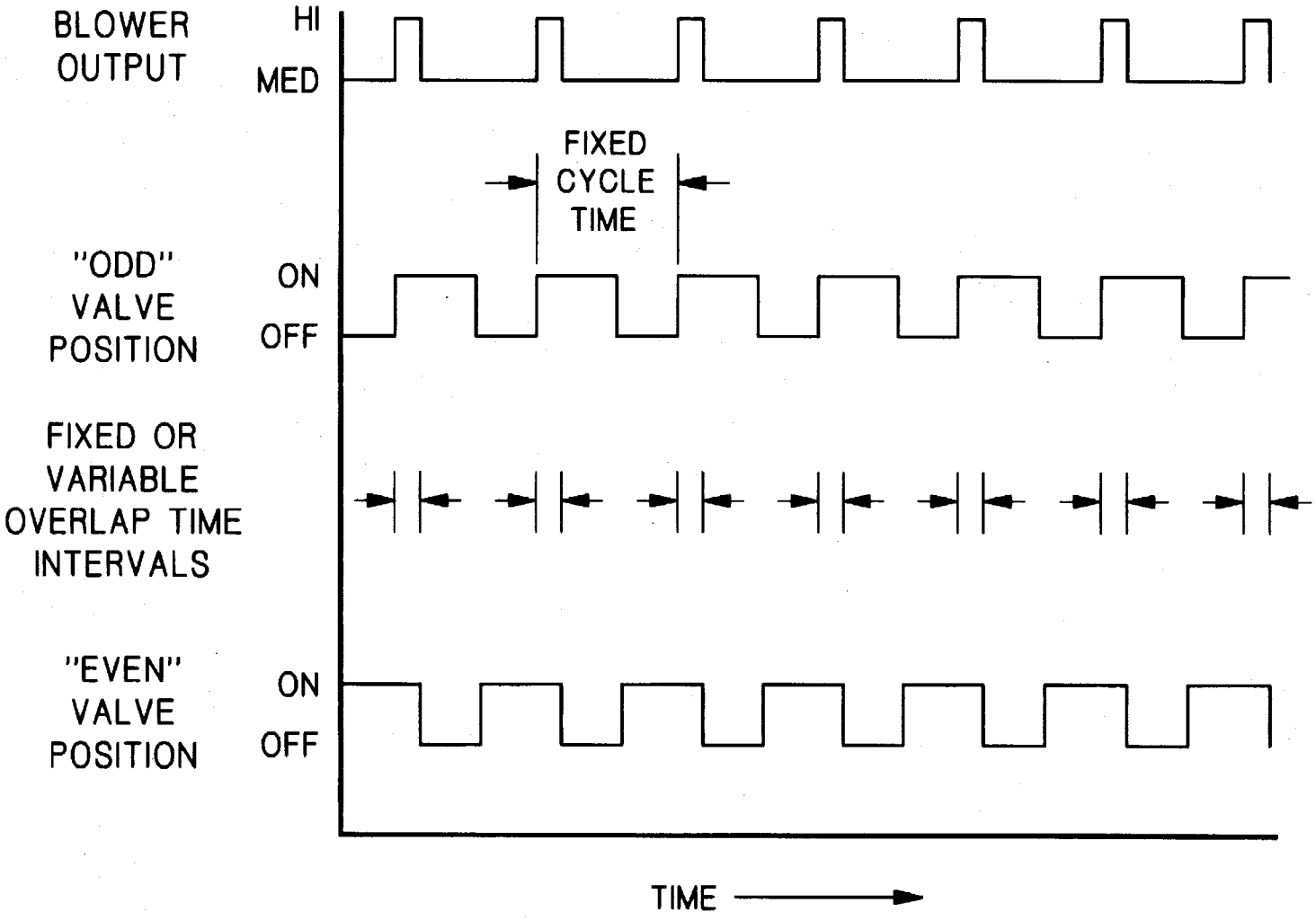
FIG. 4 shows inflation/deflation and blower pressure waveforms for an alternating pressure mattress, according to another embodiment of the present invention.

FIG. 4 illustrates a further improvement over the conventional system of alternating pressure mattress control. Here, blower output is increased during overlap intervals to compensate for the drop in pressure inherent in the control method of FIG. 3 and providing further patient stabilization during inflation/deflation transitions. The degree of increased blower output and the length of periods of overlap are both functions of patient weight; therefore, patient weight can be entered into the system controller and blower output and overlap interval set as a function thereof. Alternatively, either one of increased blower output or overlap period can be fixed and the other varied by the system controller as a function of patient weight. Also, although the cycle times are indicated as being "fixed", they may be fixed for one controller setting and may be varied for another controller setting, depending, for example, on patient weight. All three variables—blower output, overlap interval, and cycle time—or any selected two thereof, may be interrelated.

Figure 5:
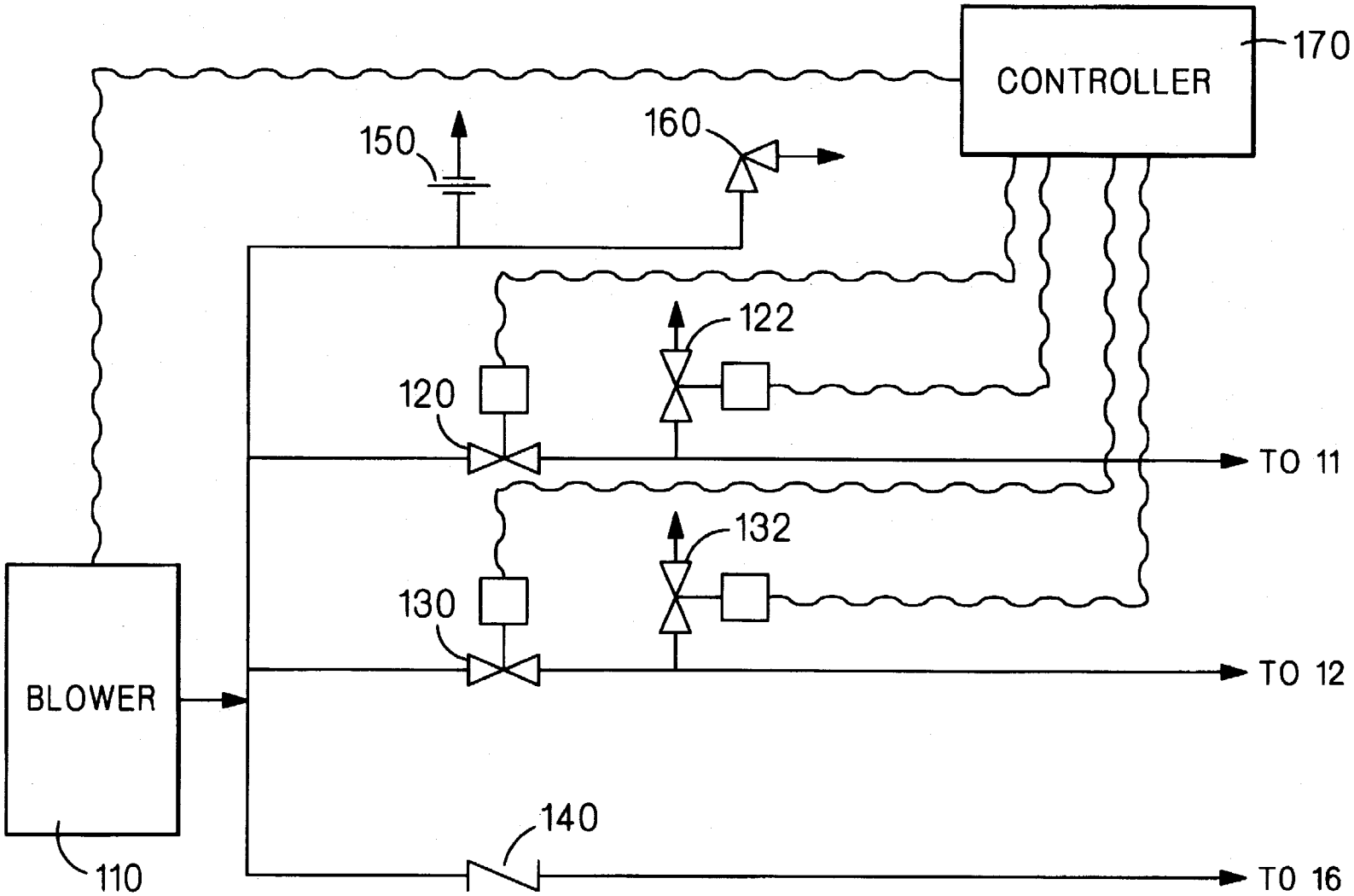
FIG. 5 is a schematic diagram of a control system for the present invention.

FIG. 5 illustrates a control system, generally indicated by the reference numeral 100, for use with either of the embodiments of the present invention shown on FIGS. 3 and 4. System 100 includes a blower 110 which provides pressurized air at about twenty inches of water pressure to odd air sacks 11 (FIG. 1), to even air sacks 12, and to lower mattress structure 16. A solenoid valve 120 disposed in the line to odd air sacks 11 opens to permit the flow of pressurized air to the odd air sacks and closes to terminate such flow, while a solenoid valve 122 connected to that line opens to exhaust air from the odd air sacks. In a similar manner, a solenoid valve 130 disposed in the line to even air sacks 12 (FIG. 1) opens to permit the flow of pressurized air to the even air sacks and closes to terminate such flow, while a solenoid valve 122 connected to that line opens to exhaust air from the odd air sacks. A check valve 140 disposed in the line to lower mattress structure 16 permits pressurized air to flow to the lower mattress structure, but prevents the exhausting of air therefrom. An air bleed 150 permits a small flow of air from the system to avoid overheating of blower 110 when no air is being furnished to alternating pressure mattress 10. A pressure relief valve 160 prevents the air pressure from exceeding about twenty inches of water pressure.

A controller 170 is electrically connected to blower 110 and to solenoid valves 120, 122, 130, and 132 to control the inflation/deflation intervals and fixed or variable overlap periods as shown on FIGS. 3 and 4 and to control blower speed as indicated on FIG. 4. As noted above, patient weight may be an input to controller 170 which then determines the optimum parameters.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. An alternating pressure mattress system, comprising:

(a) a mattress comprising a plurality of narrow, parallel, closely-spaced, horizontally adjacent air sacks, every other one of said air sacks comprising a first group of air sacks being commonly connected for the introduction thereinto of pressurized air and the others of said air sacks comprising a second group of air sacks and being commonly connected for the introduction thereinto of pressurized air;

(b) a blower to supply said pressurized air to said first and second groups of air sacks;

(c) control means to alternatingly inflate and deflate said first and second groups of air sacks for selected periods of time;

(d) said control means providing for intervals of time at inflation/deflation transitions during which periods of time said pressurized air is being furnished to both said first and second groups of air sacks; and (e) said control means further providing a control mode selected from the group consisting of:

increasing output of said blower during said intervals of time; varying duration of said intervals of time as a function of weight of a patient to be reposed on said mattress; increasing said output of said blower as a function of said weight of said patient; varying duration of periods of inflation and deflation of said first and second groups of air sacks as a function of said output of said blower; and varying said duration of periods of inflation and deflation of said first and second groups of air sacks as a function of said output of said blower and said intervals of time.

2. A method of controlling an alternating pressure mattress of the type comprising a plurality of narrow, parallel, closely-spaced, horizontally adjacent air sacks, every other one of said air sacks comprising a first group of air sacks being commonly connected for the introduction thereinto of pressurized air and the others of said air sacks comprising a second group of air sacks and being commonly connected for the introduction thereinto of pressurized air from a blower, said method comprising:

(a) supplying said pressurized air to alternatingly inflate and deflate said first and second groups of air sacks for selected periods of time;

(b) providing for intervals of time at inflation/deflation transitions during which periods of time said pressurized air is being furnished to both said first and second groups of air sacks; and (c) providing control of inflation and deflation of said first and second groups of air sacks in a mode selected from the group consisting of:

increasing output of said blower during said intervals of time; varying duration of said intervals of time as a function of weight of a patient to be reposed on said mattress; increasing said output of said blower as a function of said weight of said patient; varying duration of periods of inflation and deflation of said first and second groups of air sacks as a function of said output of said blower; and varying said duration of periods of inflation and deflation of said first and second groups of air sacks as a function of said output of said blower and said intervals of time.

* * * * *